US011091825B2

(12) United States Patent
Kawano

(10) Patent No.: US 11,091,825 B2
(45) Date of Patent: Aug. 17, 2021

(54) PREHARDENED STEEL MATERIAL, MOLD, AND MOLD COMPONENT

(71) Applicant: DAIDO STEEL CO., LTD., Nagoya (JP)

(72) Inventor: Masamichi Kawano, Nagoya (JP)

(73) Assignee: DAIDO STEEL CO., LTD., Nagoya (JP)

( * ) Notice: Subject to any disclaimer, the term of this patent is extended or adjusted under 35 U.S.C. 154(b) by 333 days.

(21) Appl. No.: 15/950,028

(22) Filed: Apr. 10, 2018

(65) Prior Publication Data

US 2018/0305799 A1 Oct. 25, 2018

(30) Foreign Application Priority Data

Apr. 19, 2017 (JP) ..... JP2017-083121
Jan. 18, 2018 (JP) ..... JP2018-006778

(51) Int. Cl.
*C22C 38/60* (2006.01)
*C22C 38/02* (2006.01)
(Continued)

(52) U.S. Cl.
CPC ..... *C22C 38/60* (2013.01); *C21D 1/18* (2013.01); *C21D 1/25* (2013.01); *C21D 6/004* (2013.01); *C21D 6/02* (2013.01); *C21D 9/0068* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01);
(Continued)

(58) Field of Classification Search
CPC ..... C21D 1/18; C22C 38/60; C22C 38/08
See application file for complete search history.

(56) References Cited

U.S. PATENT DOCUMENTS 5,785,924 A 7/1998 Beguinot et al.
6,413,329 B1 * 7/2002 Nakatsu ..... C22C 38/06 148/333
(Continued)

FOREIGN PATENT DOCUMENTS

CN 1174244 A 2/1998
CN 1718771 A 1/2006
(Continued)

OTHER PUBLICATIONS

JPH06279922 translation (Year: 2021).*
(Continued)

*Primary Examiner* — Nicholas A Wang
*Assistant Examiner* — Jiangtian Xu
(74) *Attorney, Agent, or Firm* — McGinn I.P. Law Group, PLLC.

(57) ABSTRACT

Provided is a prehardened steel material containing: 0.05≤C≤0.25 mass %, 0.01≤Si≤1.00 mass %, 0.40≤Mn≤1.80 mass %, 0.0002≤S≤0.3000 mass %, 0.30≤Cu≤1.80 mass %, 2.00≤Ni≤3.90 mass %, 0.05≤Cr≤3.20 mass %, 0.05≤Mo≤0.80 mass %, and 0.30≤Al≤1.50 mass %, with a balance being Fe and unavoidable impurities, in which the prehardened steel material has: a cross-sectional size of 350 mm or more in width and 350 mm or more in height, a hardness of 34 to 43 HRC, an average value of prior austenite grain size being 85 μm or less, and an average value of impact value being 18 J/cm$^2$ or higher.

18 Claims, 5 Drawing Sheets

Before Hardening

(51) Int. Cl.

| | |
|---|---|
| ***C22C 38/06*** | (2006.01) |
| ***C22C 38/42*** | (2006.01) |
| ***C22C 38/44*** | (2006.01) |
| ***C22C 38/52*** | (2006.01) |
| ***C22C 38/58*** | (2006.01) |
| ***C21D 6/02*** | (2006.01) |
| ***C21D 1/25*** | (2006.01) |
| ***C21D 9/00*** | (2006.01) |
| ***C21D 6/00*** | (2006.01) |
| ***C22C 38/46*** | (2006.01) |
| ***C22C 38/00*** | (2006.01) |
| ***C21D 1/18*** | (2006.01) |
| ***C22C 38/04*** | (2006.01) |
| ***C22C 38/54*** | (2006.01) |

(52) U.S. Cl.

CPC ..... *C22C 38/46* (2013.01); *C22C 38/52* (2013.01); *C22C 38/54* (2013.01); *C22C 38/58* (2013.01); *C21D 2211/001* (2013.01); *C21D 2211/002* (2013.01); *C21D 2211/004* (2013.01); *C21D 2211/008* (2013.01)

(56) References Cited

U.S. PATENT DOCUMENTS

| | | | |
|---|---|---|---|
| 2014/0083574 | A1 | 3/2014 | Nam et al. |
| 2016/0281190 | A1 | 9/2016 | Nam et al. |

FOREIGN PATENT DOCUMENTS

| | | | | |
|---|---|---|---|---|
| CN | 103534372 | A | | 1/2014 |
| CN | 103966530 | A | | 8/2014 |
| EP | 2 551 367 | A1 | | 1/2013 |
| JP | S 55-28384 | A | | 2/1980 |
| JP | S 55-28385 | A | | 2/1980 |
| JP | H 02-182860 | A | | 7/1990 |
| JP | H 03-122252 | A | | 5/1991 |
| JP | H06279922 | A | * | 3/1993 |
| JP | H 06-279922 | A | | 10/1994 |
| JP | H 11-335775 | A | | 12/1999 |
| JP | 2001-152246 | A | | 6/2001 |
| JP | 2001-152278 | A | | 6/2001 |
| JP | 2002-309341 | A | | 10/2002 |
| JP | 2005-163123 | A | | 6/2005 |
| JP | 2006-083417 | A | | 3/2006 |
| JP | 2007-262569 | A | | 10/2007 |
| JP | 2008-038219 | A | | 2/2008 |
| JP | 2008-127643 | A | | 6/2008 |

OTHER PUBLICATIONS

Korean Office Action, dated Jul. 1, 2019, in Korean Application No. 10-2018-0045353 and English Translation thereof.

D. Firrao, et al., "Influence of the Microstructure on Fatigue and Fracture Toughness Properties of Large Heat-Treated Mold Steels", Materials Science and Engineering: A, vol. 559, pp. 371-383, Jan. 1, 2013.

Javier Hidalgo, et al., "Effect of Prior Austenite Grain Size Refinement by Thermal Cycling on the Microstructural Features of As-Quenched Lath Martensite", Metallurgical and Materials Transactions A: Physical Metallurgy & Materials Science, ASM International, Materials Park, OH, US vol. 47 No. 11, pp. 5288-5301, May 5, 2016.

Extended European Search Report dated Jun. 21, 2018, in corresponding European Patent Application No. 18167613.1.

European Office Action, dated Mar. 24, 2020, in European Application No. 18 167 613.1-1103.

Chinese Office Action, dated Apr. 28, 2020, in Chinese Application No. 201810353701.1 and English Translation thereof.

Chinese Office Action, dated Oct. 18, 2019, in Chinese Application No. 201810353701.1 and English Translation thereof.

Chinese Decision of Rejection, dated Sep. 22, 2020, 201810353701.1 and English Translation thereof.

"Heat Treatment Questions and Answers about Workers" Knowledge and Answers, edited by Zhang Chengjun, p. 356, Jilin People's Publishing House, Apr. 1982 with partial English translation.

European Office Action, dated Jan. 15, 2021, in European Patent Application No. 18167613.1.

* cited by examiner

Before Hardening

After First Hardening

After Third Hardening

PREHARDENED STEEL MATERIAL, MOLD, AND MOLD COMPONENT

TECHNICAL FIELD

The present invention relates to a prehardened steel material, a mold and a mold component, and specifically relates to a mold and mold component which are used for plastic injection molding, rubber molding, CFRP molding, or the like, and to a prehardened steel material used for the mold and mold component.

BACKGROUND ART

Prehardened steel refers to steel that is hardened and tempered to a predetermined hardness and capable of machining. Prehardened steel can be used as a mold or a mold component after machining without the necessity of a heat treatment. Therefore, prehardened steel is widely used for a mold or mold component, which are used for plastic injection molding, rubber molding, CFRP molding, or the like. Regarding prehardened steel and a method of manufacturing the same, various techniques have been proposed.

For example, Patent Documents 1 and 2 disclose a method in which an Mn—Ni—Al—Cu—Mo age-hardening (free-cutting) steel for plastic mold, having a predetermined composition is subjected to a build-up welding, an aging treatment at 500° C. for 5 hr, and a photoetching.

Patent Documents 1 and 2 disclose that, by performing the aging treatment after the build-up welding, the photoetching can be uniformly performed on a weld metal part and a welding heat-affected zone as in a base metal part.

Patent Document 3 discloses a method in which an age-hardening steel for mold, having a predetermined composition is subjected to a melting, a forging, a solutionizing, and an aging treatment.

Patent Document 3 discloses that this method can provide an age-hardening steel for mold, having a hardness level of HRC40 and having excellent toughness and machinability.

Patent Document 4 discloses a method in which a forged material, which has a cross-sectional size of 50 mm×150 mm and is formed of a steel for mold having a predetermined composition, is subjected to a hardening and tempering to achieve a target hardness of HRC 34.

Patent Document 4 describes that this method can provide a steel for mold, having excellent machinability, polishability, and wear resistance.

Patent Document 5 discloses a method in which a precipitation hardening steel having a predetermined composition is prepared by a typical melting method and then, the steel is forged to achieve about 4 S, heated and held at 900° C., then, air-cooled, and then subjected to an aging treatment at 550° C. or 575° C. for 5 hours.

Patent Document 5 describes that this method can provide a precipitation hardening steel having excellent toughness and chipping resistance for cemented carbide tool.

Patent Documents 6 and 7 disclose a method in which a steel for plastic molding mold, having a predetermined composition, is subjected to a casting, then, heated to 850° C., subjected to a solutionizing, subsequently heated to 500° C., and subjected to an age hardening treatment.

Patent Documents 6 and 7 describe that this method can provide a steel for plastic molding mold, having excellent mirror polishability and machinability, or a steel for plastic molding mold, having excellent mirror polishability, weldability, and machinability.

Patent Document 8 discloses a method in which a free-cutting steel for plastic molding mold, having a predetermined composition is prepared by a typical melting method, and the obtained steel is forged, subjected to a hot working, heated to 1,143 K for solutionizing, and subsequently heated to 773 K to perform an age hardening treatment.

Patent Document 8 describes that this method can provide a free-cutting steel for plastic molding mold, having excellent mirror polishability.

Patent Document 9 discloses a method in which a prehardened steel having a predetermined composition is hot-rolled, heated to an austenite temperature range of 880° C., subjected to a bainite producing heat treatment (bainite hardening) under cooling conditions of 5 minutes of half-cooling, 15 minutes of half-cooling, 30 minutes of half-cooling, and 70 minutes of half-cooling, and then, subjected to a tempering in a temperature range of 500° C. to 550° C. to adjust a hardness to 38 to 40 HRC.

Patent Document 9 describes that this method can provide a prehardened steel having excellent machinability and toughness.

Patent Document 10 discloses a method in which a prehardened steel having a predetermined composition is hot-rolled, heated to an austenite temperature range of 880° C., air-cooled (allowed to cool), and subjected to a tempering in a temperature range of 500° C. to 590° C.

Patent Document 10 describes that this method can provide a prehardened steel having excellent machinability and toughness.

Patent Document 11 discloses a method in which a prehardened steel having a predetermined composition is hot-rolled, heated to and held at an austenite temperature range of 880° C., air-cooled (allowed to cool) for hardening, and subjected to tempering in a temperature range of 500° C. to 590° C.

Patent Document 11 describes that this method can provide a prehardened steel having excellent machinability and toughness.

For prehardened steel used for a mold for plastic injection molding or the like, there are increasing demands on an increase in cross-sectional size, grain refinement and an increase in impact value. Hereinafter, plastic injection molding will be described as an example.

(1) Increase in Cross-Sectional Size:

Along with an increase in the size of a product (e.g., a headlight of a vehicle), a steel for mold also tends to increase in a cross-sectional size. Conventionally, a mold is manufactured by machining a steel material having a cross-sectional size of 300 mm or less in width and 300 mm or less in height. However, recently, a mold has been manufactured from a steel material having a large cross-sectional size of 350 mm or more in width and 350 mm or more in height.

(2) Grain Refinement:

In injection molding, a smoothly polished mold surface is transferred to a product. However, if grains of a mold are coarse, the polished mold surface is likely to be uneven due to the effect of the grain size. In this case, unevenness is transferred to a surface of an injection molded product of plastic, to thereby deteriorate the appearance of the product. Therefore, a grain refinement is required for steel materials for mold. In order to refine the grain, adjustment in conditions for plastic working or heat treatment in a manufacturing process of a steel material for mold has been performed. Specifically, for example, the temperature of plastic working is reduced to increase a working ratio, or the temperature and time of prehardening are reduced. In addition, a grain refinement is also important from the viewpoint of increasing an impact value described below.

(3) Increase in Impact Value:

In injection molding, a mold is required not to crack during use. If a mold cracks, loss may occur due to production stop, or the costs may increase due to remanufacturing of a mold. In order to avoid cracking, an impact value of the mold is preferably high. In general, as the hardenability of a steel material increases, the impact value of the steel material increases. Therefore, in prehardening of a steel material for mold, rapid cooling is adopted. In addition, as the grain size of a steel material decreases, the impact value of the steel material increases. Therefore, as described above, the adjustment in conditions for plastic working or heat treatment in a manufacturing process of a steel material is important.

However, in the case where a prehardened steel material having a large cross-sectional size (350 mm or more in width and 350 mm or more in height) is manufactured by a conventional method, a grain refinement and an increase in impact value are insufficient.

The reason why the grain is not sufficiently refined is that it is difficult to reduce the temperature at working and to increase a working ratio in plastic working in a manufacturing process of a steel material. This is because, as a working area and a deformation resistance increase, a working force corresponding to the product of the working area and the deformation resistance increases and exceeds the capability of a working device.

There are two reasons why the impact value is not sufficiently increased. First, as described above, it is difficult to refine the grain. Second, in prehardening, particularly, the cooling rate at the central part of a steel material is low (mass effect).

Due to the above-described reasons, in a prehardened steel material having a large cross-sectional size (350 mm or more in width and 350 mm or more in height) used for a mold for plastic injection molding or the like, a grain refinement and an increase in impact value were not satisfied at the same time in the related art.

Patent Document 1: JP-A-S55-28384
Patent Document 2: JP-A-S55-28385
Patent Document 3: JP-A-H02-182860
Patent Document 4: JP-A-H03-122252
Patent Document 5: JP-A-H06-279922
Patent Document 6: JP-A-H11-335775
Patent Document 7: JP-A-2001-152278
Patent Document 8: JP-A-2002-309341
Patent Document 9: JP-A-2007-262569
Patent Document 10: JP-A-2008-038219
Patent Document 11: JP-A-2008-127643

SUMMARY OF THE INVENTION

An object of the present invention is to provide a prehardened steel material having a large cross-sectional size (350 mm or more in width and 350 mm or more in height), and having a small grain size and a high impact value.

In addition, another object of the present invention is to provide a mold and mold component formed of such a prehardened steel material.

In order to achieve the objects, the prehardened steel material according to the present invention has the following configurations.

(1) The Prehardened Steel Material Contains:

$0.05 \leq C \leq 0.25$ mass %,
$0.01 \leq Si \leq 1.00$ mass %,
$0.40 \leq Mn \leq 1.80$ mass %,
$0.0002 \leq S \leq 0.3000$ mass %,
$0.30 \leq Cu \leq 1.80$ mass %,
$2.00 \leq Ni \leq 3.90$ mass %,
$0.05 \leq Cr \leq 3.20$ mass %,
$0.05 \leq Mo \leq 0.80$ mass %, and
$0.30 \leq Al \leq 1.50$ mass %,
with a balance being Fe and unavoidable impurities.

(2) The Prehardened Steel Material has:

a cross-sectional size of a width of 350 mm or more and a height of 350 mm or more,
a hardness of 34 to 43 HRC,
an average value of prior austenite grain size being 85 μm or less, and
an average value of impact value being 18 J/cm$^2$ or higher.

The mold according to the present invention contains the prehardened steel material according to the present invention, and has a size in which maximum values in at least two directions among three directions of a vertical direction, a horizontal direction and a height direction are 350 mm or more.

Furthermore, the mold component according to the present invention contains the prehardened steel material according to the present invention, and has a size in which maximum values in at least two directions among three directions of a vertical direction, a horizontal direction and a height direction are 350 mm or more.

In general, in the case where a prehardened steel material is hardened and tempered, as the cross-sectional area of the steel material increases, the cooling rate at the central part decreases. Therefore, the grain size of the central part increases, and the impact value decreases. In order to solve the problem, an increase in cooling rate is worth considering. However, in the case where the cross-sectional area of the steel material exceeds a predetermined size, there is a limit in increasing the cooling rate.

On the other hand, when a prehardened steel material having a predetermined composition and a large cross-sectional size is subjected to multiple times of hardening, even in the case where there is a limit in cooling rate, the grain size of the central part can be reduced. Furthermore, the prehardened steel material according to the present invention has an impact value reaching a maximum value at a certain cooling rate. Therefore, even in a steel material having a large cross-sectional area, the steel material has a fine grain microstructure in the entire area of a cross-section, and improved hardness and impact value in the entire area of the cross-section.

BRIEF DESCRIPTION OF THE DRAWINGS

FIG. 7A shows a microstructure after performing one hardening and tempering; and FIG. 7B shows a microstructure after performing rehardening.

MODE FOR CARRYING OUT THE INVENTION

Figure 1A:
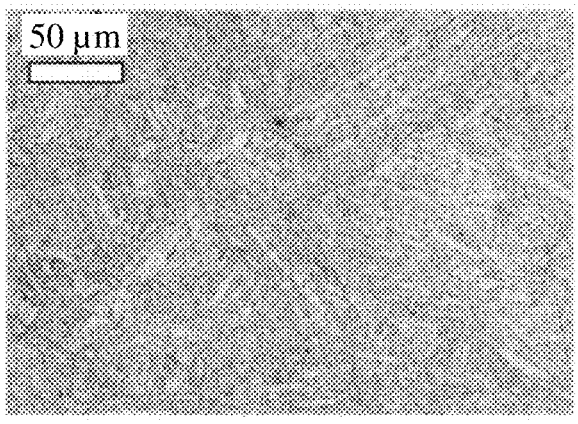
FIG. 1A, FIG. 1B and FIG. 1C are images showing a microstructure before hardening (FIG. 1A), a microstructure after the first hardening (FIG. 1B), and a microstructure after the third hardening (FIG. 1C) of the prehardened steel material according to the present invention.

Hereinafter, an embodiment of the present invention will be described in detail.

1. Prehardened Steel Material

The prehardened steel material according to the present invention has the following configurations.

(1) The Prehardened Steel Material Contains:

0.05≤C≤0.25 mass %,
0.01≤Si≤1.00 mass %,
0.40≤Mn≤1.80 mass %,
0.0002≤S≤0.3000 mass %,
0.30≤Cu≤1.80 mass %,
2.00≤Ni≤3.90 mass %,
0.05≤Cr≤3.20 mass %,
0.05≤Mo≤0.80 mass %, and
0.30≤Al≤1.50 mass %,
with a balance being Fe and unavoidable impurities.

(2) The Prehardened Steel Material has:

a cross-sectional size of 350 mm or more in width and 350 mm or more in height,
a hardness of from 34 to 43 HRC,
an average value of prior austenite grain size being 85 μm or less, and
an average value of impact value being 18 J/cm$^2$ or higher.

1.1. Composition 1.1.1. Major Constituent Elements

The prehardened steel material according to the present invention contains the following elements and a remainder is Fe and unavoidable impurities. The kinds of the elements, composition ranges thereof, and the reasons for limiting the composition ranges are as follows.

(1) 0.05≤C≤0.25 Mass %:

In the case where the C content is low, if the content of Cu, Ni, Al, and/or Mo is also low, it is difficult to stably achieve a hardness of 34 HRC or higher. Accordingly, the C content is necessarily 0.05 mass % or higher. The C content is preferably 0.06 mass % or higher and more preferably 0.07 mass % or higher.

On the other hand, in the case where the C content is excessively high, the steel material becomes excessively hard and machinability deteriorates. In addition, in the case where the C content is excessively high, weldability deteriorates. Accordingly, the C content is necessarily 0.25 mass % or lower. The C content is preferably 0.23 mass % or lower and more preferably 0.21 mass % or lower.

(2) 0.01≤Si≤1.00 Mass %:

In the case where the Si content is low, machinability, in particular, end mill machinability largely deteriorates. Accordingly, the Si content is necessarily 0.01 mass % or higher. The Si content is preferably 0.02 mass % or higher and more preferably 0.03 mass % or higher.

On the other hand, in the case where the Si content is excessively high, thermal conductivity remarkably deteriorates. In order to improve the productivity in injection molding, it is necessary to reduce the solidification time of plastic injected into a mold. To that end, a mold material having high thermal conductivity is required. Accordingly, the Si content is necessarily 1.00 mass % or lower. The Si content is preferably 0.90 mass % or lower and more preferably 0.80 mass % or lower.

(3) 0.40≤Mn≤1.80 Mass %:

In the case where the Mn content is low, hardenability is insufficient, and pro-eutectoid ferrite is likely to precipitate during hardening. Pro-eutectoid ferrite is soft and thus, causes polishing unevenness during mirror polishing. In addition, a mold is likely to crack during use from soft pro-eutectoid ferrite as an origin. Accordingly, the Mn content is necessarily 0.40 mass % or higher. The Mn content is preferably 1.20 mass % or higher and more preferably 1.37 mass % or higher.

On the other hand, in the case where the Mn content is excessively high, thermal conductivity remarkably deteriorates. Accordingly, the Mn content is necessarily 1.80 mass % or lower. The Mn content is preferably 1.75 mass % or lower and more preferably 1.70 mass % or lower.

(4) 0.0002≤S≤0.3000 Mass %:

In the case where the S content is low, an effect of improving machinability due to formation of MnS is poor. In the present invention, since the Mn content is high, even in the case of a low S content, MnS is formed and machinability is improved. In order to obtain the effect, the S content is necessarily 0.0002 mass % or higher. The S content is preferably 0.0003 mass % or higher and more preferably 0.0004 mass % or higher.

On the other hand, in the case where the S content is excessively high, not only the effect of improving machinability is substantially saturated, but also an excess amount of MnS is formed and thus, impact value, mirror polishability and weldability deteriorate. Accordingly, the S content is necessarily 0.3000 mass % or lower. The S content is preferably 0.2250 mass % or lower and more preferably 0.1000 mass % or lower.

(5) 0.30≤Cu≤1.80 Mass %:

In the case where the Cu content is low, the amount of E-Cu precipitating during tempering is small. Therefore, if the content of C, Ni, Al, and/or Mo is also low, it is difficult to stably achieve a hardness of 34 HRC or higher. In addition, in the case where the Cu content is low, an effect of improving hardenability is poor. Accordingly, the Cu content is necessarily 0.30 mass % or higher. The Cu content is preferably 0.40 mass % or higher and more preferably 0.80 mass % or higher.

On the other hand, in the case where the Cu content is excessively high, the amount of ε-Cu precipitating during tempering is excessively large, leading to decrease in the impact value. In addition, an excessively high Cu content also leads to deterioration in thermal conductivity and significant increase in costs. Accordingly, the Cu content is necessarily 1.80 mass % or lower. The Cu content is preferably 1.65 mass % or lower and more preferably 1.30 mass % or lower.

(6) 2.00≤Ni≤3.90 Mass %:

In the case where the Ni content is low, the amount of an intermetallic compound of Ni and Al precipitating during tempering is small. Therefore, if the content of C, Cu, Al, and/or Mo is also low, it is difficult to stably achieve a hardness of 34 HRC or higher. In addition, an effect of avoiding cracking during hot working of high-Cu steel is poor. Accordingly, the Ni content is necessarily 2.00 mass % or higher. The Ni content is preferably 2.60 mass % or higher and more preferably 2.90 mass % or higher.

On the other hand, in the case where the Ni content is excessively high, the amount of the intermetallic compound of Ni and Al precipitating during tempering is excessively large, leading to decrease in the impact value. In addition, an excessively high Ni content also leads to significant increase in costs. Accordingly, the Ni content is necessarily 3.90 mass % or lower. The Ni content is preferably 3.80 mass % or lower and more preferably 3.70 mass % or lower.

(7) 0.05≤Cr≤3.20 Mass %:

In the case where the Cr content is low, corrosion resistance significantly deteriorates. In addition, weather resistance provided due to the presence of Cu—Cr is also insufficient. The steel material of the present invention is not intended to be used for an application where high corrosion resistance is required, but is required to have a corrosion resistance to the extent that formation of rust is suppressed during a manufacturing process of a mold or during use. Accordingly, the Cr content is necessarily 0.05 mass % or higher. The Cr content is preferably 0.08 mass % or higher and more preferably 0.24 mass % or higher.

On the other hand, in the case where the Cr content is excessively high, machinability deteriorates. In addition, an excessively high Cr content also leads to significant deterioration in thermal conductivity. Accordingly, the Cr content is necessarily 3.20 mass % or lower. The Cr content is preferably 2.85 mass % or lower and more preferably 0.60 mass % or lower.

(8) 0.05≤Mo≤0.80 Mass %:

In the case where the Mo content is low, the amount of a carbide precipitating during tempering is small. Therefore, if the content of C, Cu, Ni, and/or Al is also low, it is difficult to stably achieve a hardness of 34 HRC or higher. In addition, in the case where the Mo content is low, proeutectoid ferrite is likely to precipitate during hardening. Accordingly, the Mo content is necessarily 0.05 mass % or higher. The Mo content is preferably 0.07 mass % or higher and more preferably 0.10 mass % or higher.

On the other hand, in the case where the Mo content is excessively high, tempering hardness is excessively high and machinability deteriorates. Accordingly, the Mo content is necessarily 0.80 mass % or lower. The Mo content is preferably 0.70 mass % or lower and more preferably 0.50 mass % or lower.

(9) 0.30≤Al≤1.50 Mass %:

In the case where the Al content is low, the amount of the intermetallic compound of Al and Ni precipitating during tempering is small. Therefore, if the content of C, Cu, Ni, and/or Mo is also low, it is difficult to stably achieve a hardness of 34 HRC or higher. In addition, in the case where the Al content is low, an increase in hardness during nitriding is small. Accordingly, the Al content is necessarily 0.30 mass % or higher. The Al content is preferably 0.60 mass % or higher and more preferably 0.80 mass % or higher.

On the other hand, in the case where the Al content is excessively high, the amount of the intermetallic compound of Al and Ni precipitating during tempering is excessively large, and the impact value decreases. In addition, in the case where the Al content is excessively high, deterioration in thermal conductivity is significant and occurrence of cracking during hot working becomes obvious. Furthermore, an excessively high Al content also leads to a problem of increasing in costs. Accordingly, the Al content is necessarily 1.50 mass % or lower. The Al content is preferably 1.40 mass % or lower and more preferably 1.30 mass % or lower.

(10) Unavoidable Impurities:

As unavoidable impurities, the prehardened steel material according to the present invention may contain:

P≤0.05 mass %,
N≤0.015 mass %,
O≤0.01 mass %,
W≤0.30 mass %,
Co≤0.30 mass %,
V≤0.12 mass %,
Nb≤0.05 mass %,
Ta≤0.05 mass %,
Ti≤0.12 mass %,
Zr≤0.12 mass %,
B≤0.0001 mass %,
Ca≤0.0005 mass %,
Se≤0.03 mass %,
Te≤0.005 mass %,
Bi≤0.01 mass %,
Pb≤0.03 mass %,
Mg≤0.02 mass %, or
REM≤0.10 mass %.

1.1.2. Minor Constituent Elements

In addition to the above-described major constituent elements, the prehardened steel material according to the present invention may further contain one element or two or more elements selected from the following elements. The kinds of the addition elements, composition ranges thereof, and the reasons for limiting the composition ranges are as follows.

(11) 0.30<W≤1.00 Mass %:

(12) 0.30<Co≤2.00 Mass %:

The prehardened steel material according to the present invention has a relatively low C content, and thus it may be difficult to secure a hardness of 34 HRC in some cases. In such cases, W or Co may be selectively added to secure the strength. In order to obtain the effect, each of the W content and the Co content is preferably within the above-described range. Either or both of W and Co may be added.

(13) 0.0001<B≤0.0050 Mass %:

As a measure for improving hardenability, addition of B is also effective. B is also effective for improving machinability. The improvement in machinability can be achieved by forming BN. BN has similar properties to graphite, and reduces cutting resistance and simultaneously improves chip breakability. N is sufficient in the impurity level (N≤0.015 mass %) of the present invention. In the case where B and BN are present in the steel, hardenability and machinability are improved at the same time. In order to obtain this effect, the B content is preferably within the above-described range.

(14) 0.0005<Ca≤0.2000 Mass %:

(15) 0.03<Se≤0.50 Mass %:

(16) 0.005<Te≤0.100 Mass %:

(17) 0.01<Bi≤0.50 Mass %:

(18) 0.03<Pb≤0.50 Mass %:

In order to improve machinability, selective addition of Ca, Se, Te, Bi, and/or Pb is also effective. Free-cutting compounds formed from these elements are finer than MnS and less extend than MnS does. Therefore, the free-cutting compounds have a lesser degree of adverse influence on the impact value than that of MnS. In order to obtain this effect, each of the contents of the above-described elements is preferably within the above-described range. One element or two or more elements selected from the above-described elements may be added.

1.2. Cross-Sectional Size

The prehardened steel material according to the present invention has a cross-sectional size of width of 350 mm or more and a height of 350 mm or more.

Here, "width" and "height" refer to dimensions of the cross-section perpendicular to a direction (so-called a "fiber direction") in which the length of the material finally extends when the material undergoes hot plastic working. Regarding which one of the dimensions is taken as the width and which one of the dimensions is taken as the height, a smaller value is defined as the height. Even in the case where a steel material is cut from an extremely large raw material or an extremely long raw material such that the fiber direction is not clear from the external appearance, the fiber direction can be determined by the microstructure. Specifically, the fiber direction can be determined by evaluating a direction of segregation, a distribution of an inclusion, an elongated direction of the inclusion, and the like.

The prehardened steel material according to the present invention not only has a large cross-sectional size, but also satisfies conditions regarding the hardness, prior austenite grain size and impact value described below, over the entire area of the cross-section. The prehardened steel material can be obtained by repeatedly hardening a steel material having the predetermined composition range multiple times as described below. Therefore, the prehardened steel material according to the present invention has less limitation in cross-sectional size than a conventional steel material. The cross-sectional size in the present invention will be mainly limited by the amount of molten steel obtained by one melting and casting. However, there is no practical advantage in increasing the cross-sectional size more than necessary.

The method described below can produce a steel material having a width of 3,000 mm or less, 2,800 mm or less, or 2,600 mm or less.

The method described below can produce a steel material having a height of 1,500 mm or less, 1,400 mm or less, or 1,300 mm or less.

The length of the prehardened steel material according to the present invention in the fiber direction is determined based on the amount of molten steel and the cross-sectional size. The method described below can produce a steel material having a length in the fiber direction of 200 mm or more, 1,000 mm or more, or 2,000 mm or more. The maximum length in the fiber direction may be 18,000 mm or less.

1.3. Hardness

The prehardened steel material according to the present invention has a hardness of from 34 to 43 HRC. This value is satisfied over the entire area of the cross-section of the steel material. The hardness is preferably from 34 to 42 HRC and more preferably from 35 to 42 HRC. The hardness can be measured by using a Rockwell hardness tester on a polished or grinded surface of a steel material at a room temperature (around 16° C. to 30° C.). In the present invention, an average value of values at five or six measured points is employed as the hardness.

1.4. Prior Austenite Grain Size

The prehardened steel material according to the present invention has an average value of prior austenite grain size of 85 μm or less. The "average value" refers to an average value of prior austenite grain size values measured on the entire area of the cross-section of the steel material (or representative portions in the cross-section).

The prehardened steel material according to the present invention can be manufactured by performing hardening under predetermined conditions multiple times. Therefore, the average value of prior austenite grain size is smaller than that of a conventional steel material having the same cross-sectional size. By optimizing manufacturing conditions, the average value of prior austenite grain size can achieve 80 μm or less, 75 μm or less, or 70 μm or less.

The prior austenite grain size refers to an austenite grain size "during hardening" determined based on a microstructure (martensite or bainite) after hardening. Prior austenite grains can be identified by color contrasts and clear linear grain boundaries when etched a hardened steel material with an acid to expose a microstructure and observing it with an optical microscope at a magnification of 50 to 200 times. In the case where contrasts or grain boundaries of grains are not clear, grains can be identified by analyzing crystal orientations. In this case, a prior austenite grain boundary in which a difference between orientations of adjacent grains is 15° or more is defined as a grain boundary.

Prior austenite grain size is calculated by observing a wide range of a hardened microstructure in which prior austenite grain boundaries are made clear by the above-described method. For the calculation, the number n (10 or more) of grains in an observation visual field and the sum S of areas of the grains are obtained by image processing, an average area A (=S/n) of one prior austenite grain is obtained therefrom, and the diameter of a true circle having an area of A is set as the average value of prior austenite grain size.

In order to calculate the average value of prior austenite grain size, a grain size number G may also be used. The number of prior austenite grains present in a predetermined observation area is calculated from G.

1.5. Impact Value

The prehardened steel material according to the present invention has an average value of impact value being 18 $J/cm^2$ or higher. The "impact value" refers to a value obtained by dividing absorption energy in a U notch impact test by the cross-sectional area of a test piece. The "average value" refers to an average value of values of impact value measured on the entire area of the cross-section of the steel material (or representative portions in the cross-section). In the present invention, the impact value is obtained by dividing absorption energy [J] by the cross-sectional area: 0.8 $cm^2$ of a U notch test piece (test piece length: 55 mm, test piece width: 10 mm, test piece height: 10 mm, height below notch: 8 mm, notch bottom radius: 1 mm) when the test piece is fractured by impact at room temperature in the range of from 16° C. up to 30° C. The average value of 10 test pieces is defined as "average value of impact value".

The prehardened steel material according to the present invention can be manufactured by performing hardening under predetermined conditions multiple times.

Therefore, the average value of impact value is smaller than that of a conventional steel material having the same cross-sectional size. By optimizing manufacturing conditions, the average value of impact value can achieve 19 $J/cm^2$ or more, 20 $J/cm^2$ or more, or 21 $J/cm^2$ or more.

2. Mold

The mold according to the present invention is formed of the prehardened steel material according to the present invention, and has a size in which maximum values in at least two directions among three directions of a vertical direction, a horizontal direction, and a height direction are 350 mm or more.

The prehardened steel material according to the present invention has relatively high hardness and impact value despite the large cross-sectional size. Therefore, the prehardened steel material according to the present invention is particularly suitable as a raw material for a large-sized mold.

3. Mold Component

The mold component according to the present invention is formed of the prehardened steel material according to the present invention, and has a size in which maximum values in at least two directions among three directions of a vertical direction, a horizontal direction, and a height direction are 350 mm or more.

The prehardened steel material according to the present invention has relatively high hardness and impact value despite the large cross-sectional size. Therefore, the prehardened steel material according to the present invention is particularly suitable as a raw material for a large-sized mold component.

Examples of the large-sized mold component include a sprue core, an insert and a main mold.

4. Method of Manufacturing Prehardened Steel

The prehardened steel material according to the present invention can be manufactured through a method including:

(a) melting and casting raw materials blended to obtain a predetermined composition range, to prepare an ingot;

(b) homogenizing the obtained ingot;

(c) performing plastic working on the homogenized ingot;

(d) performing multiple times of hardening on the material having undergone the plastic working; and (e) tempering the hardened material.

The obtained prehardened steel is used for various applications after machining.

4.1. Melting and Casting Step

First, raw materials blended to obtain a predetermined composition range are melted and cast (melting and casting step), to prepare an ingot. A melting method and conditions thereof, and casting method and conditions thereof are not particularly limited. Optimum methods and conditions can be selected according to the purpose.

4.2. Homogenizing Step

Next, the obtained ingot is homogenized (homogenizing step). Homogenizing is performed for the purpose of removing segregation occurring during melting and casting.

Homogenizing conditions are not particularly limited as long as this purpose can be achieved. Optimum homogenizing conditions may be typically from 1,100° C. to 1,350° C. and from 4 hours to 100 hours although they depend on the composition and cross-sectional size of the steel material.

4.3. Plastic Working Step

Next, plastic working is performed on the homogenized ingot. The plastic working is performed for the purpose of obtaining a desired shape and refining the casting structure. A method and conditions of the plastic working are not particularly limited as long as this purpose can be achieved.

4.4. Hardening Step

Next, the material having undergone the plastic working is hardened multiple times (repeated hardening step). The average value of prior austenite grain size can be adjusted to be a predetermined value or less by performing hardening repeatedly, even in the case of a steel material having a large cross-sectional size.

4.4.1. Hardening Temperature

In the case where the hardening temperature is excessively low, ferrite phase does not sufficiently disappear, and hardening is insufficient. Accordingly, the hardening temperature is preferably $A_{c3}$ point (temperature at which ferrite phase disappears)−30° C. or higher. The hardening temperature is preferably $A_{c3}$ point−25° C. or higher, and more preferably $A_{c3}$ point−20° C. or higher.

On the other hand, in the case where the hardening temperature is excessively high, austenite grains are coarsened during heating at the hardening temperature.

Accordingly, the hardening temperature is preferably $A_{c3}$ point+60° C. or lower. The hardening temperature is more preferably $A_{c3}$ point+57° C. or lower, and further preferably $A_{c3}$ point+55° C. or lower.

4.4.2. Cooling Rate

The impact value of the prehardened steel material according to the present invention depends on the cooling rate in hardening and the prior austenite grain size. Unlike typical steel materials, the impact value of the prehardened steel according to the present invention reaches a maximum value at a certain cooling rate. In addition, as the prior austenite grain size decreases, the impact value increases. Therefore, each case of an excessively high cooling rate and an excessively low cooling rate cause decrease in the impact value in the outer peripheral part or the central part. The optimum cooling rate varies depending on the composition, cross-sectional size, prior austenite grain size, and the like of the steel material. Therefore, the optimum cooling rate is preferably selected according to these conditions.

As a coolant during hardening, for example, oil of 120° C. or lower, water of 95° C. or lower, high-pressure inert gas, and air are recommended. Furthermore, it is also recommended to forcibly circulate the coolant by convection. In order to make cooling rates of the surface and the inside close to each other as possible, the temperature may be held at constant (isothermal holding) during cooling process, or the kind or convection intensity of the coolant may be changed several times during cooling process.

4.4.3. Number of Times of Hardening

The prehardened steel according to the present invention was repeatedly hardened at around $A_{c3}$ point. At this time, a microstructural change was investigated in detail. As a result, it was found that the following phenomenon occurs during heating for hardening:

(a) fine austenite grains are generated from bainite or martensite as an initial microstructure;

(b) a portion where the fine grains are generated is a prior austenite grain boundary of bainite or martensite before heating; and (c) the fine grains expand its area into the inside of the prior austenite grains such that the entire surface of the microstructure is replaced with the fine grains.

This phenomenon is very similar to the behavior in which the austenite microstructure is recrystallized by plastic working.

In the case where the prior austenite grains of bainite or martensite as the initial microstructure are extremely coarse, the replacement of the prior austenite grains with the fine grains is not sufficiently performed with one hardening. Therefore, in the austenite microstructure at the time of holding a material at the hardening temperature, coarse grains remain to form a significantly mixed grain structure.

On the other hand, even in the case where the prior austenite grain of bainite or martensite as the initial microstructure is extremely coarse, the refinement with the fine grains is repeated by repeating hardening at around $A_{c3}$ point multiple times. As a result, the amount of coarse grains that remain without being replaced is gradually reduced and finally, the entire surface of the microstructure is replaced with the fine grains.

In order to obtain this effect, the number of times of hardening is preferably two or more. The number of times of hardening is preferably three or more and more preferably four or more.

On the other hand, there is no practical advantage in increasing the number of times of hardening more than necessary and also, the costs increases. Accordingly, the number of times of hardening is preferably seven or less. The number of times of hardening is preferably six or less and more preferably five or less.

4.5. Tempering Step

Next, the hardened material is tempered (tempering step). Tempering conditions are not particularly limited, and optimum conditions can be selected according to the purpose. Optimum tempering conditions may be typically from 500° C. to 600° C. and from 0.5 hours to 12 hours although they depend on the composition and cross-sectional size of the steel material. In order to temper martensite or bainite, which is produced through decomposition of retained austenite by tempering, to thereby adjust the hardness, tempering may be repeated multiple times. In the component system of the present invention, tempering will also be called "aging".

5. Effect

In general, in the case where the prehardened steel material is hardened and tempered, as the cross-sectional area of the steel material increases, the cooling rate at the central part decreases. Therefore, the grain size at the central part increases and the impact value decreases. In order to solve the problem, an increase in cooling rate is also worth considering. However, in the case where the cross-sectional area of the steel material exceeds a predetermined size, there is a limit in increasing the cooling rate.

On the other hand, when a prehardened steel material having a predetermined composition and a large cross-sectional size is subjected to multiple times of hardening, even in the case where there is a limit in cooling rate, the grain size of the central part can be reduced. Furthermore, the prehardened steel material according to the present invention has an impact value reaching a maximum value at a certain cooling rate. Therefore, even in a steel material having a large cross-sectional area, the steel material has a fine grain microstructure in the entire area of a cross-section, and improved hardness and impact value in the entire area of the cross-section.

EXAMPLES

Example 1: Dependence of Prior Austenite Grain Size on Number of Times of Hardening 1. Preparation of Sample A prehardened steel material having a chemical composition represented by 0.14C-0.45Si-1.5Mn-0.0090S-0.91Cu-3.13Ni-0.25Cr-0.25Mo-1.10Al (hereinafter, referred to as "steel A") was melted and cast to prepare an ingot. Next, the obtained ingot was homogenized at 1,280° C. for 24 hours, followed by plastic working, to thereby obtain a steel material having a cross-sectional size of width: 1,050 mm and height: 700 mm. The prior austenite grain size before hardening was controlled by pass schedule and temperature management in the hot plastic working.

Next, the obtained steel material was repeatedly hardened from 1 to 6 times. Heating conditions during hardening were 872° C. and 30 minutes. As a coolant, water of 25° C. to 45° C. was used.

2. Test Method

A change in microstructure before and after hardening was observed with a microscope. In addition, the prior austenite grain size was measured from a microstructure image. The method of determining the grain size is as follows.

The microstructures before and after hardening were etched with an acid and a difference between them was observed with a microscope. In addition, a grain size (prior austenite grain size) of an austenite microstructure before transformation was measured from the microstructure image of martensite or bainite. Prior austenite grain boundaries were corroded and observed as lines. In the case where grain boundaries were not clear, the grain boundaries were comprehensively determined in consideration of not only prior austenite grain boundaries that appeared as an intermittent line but also block boundaries of martensite or bainite. In addition, grain boundaries may also be determined by analyzing crystal orientations by an electron backscatter diffraction pattern (EBSD) method. In this case, a prior austenite grain boundary in which a difference between orientations of adjacent grains is 15° or more was defined as "grain boundary".

3. Result 3.1. Microstructure

Figure 1B:
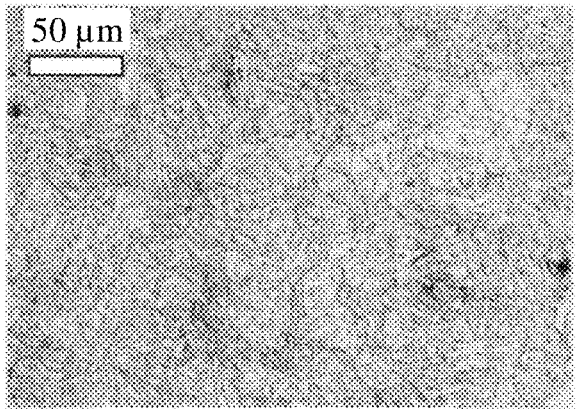
Figure 1C:
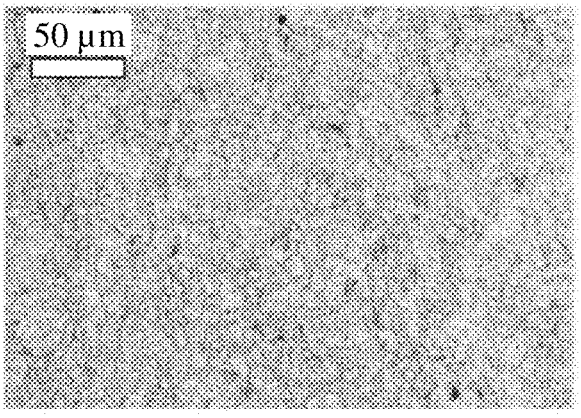

FIG. 1A, FIG. 1B and FIG. 1C are images showing a microstructure before hardening (FIG. 1A), a microstructure after the first hardening (FIG. 1B), and a microstructure after the third hardening (FIG. 1C) of the prehardened steel material (steel A) according to the present invention. In the steel A before hardening, as shown in FIG. 1A, the microstructure was mainly formed of martensite, and the average value of prior austenite grain size thereof was 195 μm.

In the steel A after the first hardening, as shown in FIG. 1B, the grain size was not sufficiently reduced, and coarse grains that remained without being replaced by fine grains were observed in a lower left region of the visual field. In this case, the number of fine grains generated is insufficient. Therefore, even in the case where the holding time at 872° C. is extended, the surface cannot be replaced entirely with fine grains as long as the number of times of hardening is one.

On the other hand, in the steel A after the third hardening, as shown in FIG. 1C, the entire surface was replaced with fine grains having an average grain size of about 25 μm.

3.2. Prior Austenite Grain Size

Figure 2:
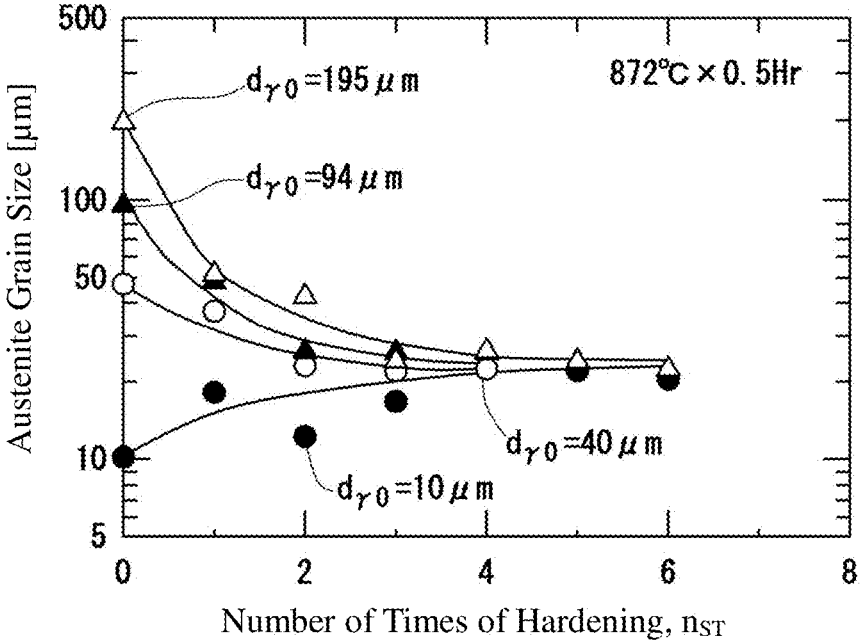
FIG. 2 is a graph showing a relationship between the number of times of hardening and an austenite grain size.

FIG. 2 shows a relationship between the number of times of hardening and an austenite grain size. In FIG. 2, $d_{\gamma 0}$ represents an initial prior austenite grain size before hardening. The following can be seen from FIG. 2. (a) In the case where $d_{\gamma 0}$ was 10 μm, the prior austenite grain size was increased by repeating hardening. It is considered that this is because grains grew due to heating during hardening. (b) In the case where $d_{\gamma 0}$ was 40 μm or more, as the number of times of hardening increased, a decrease rate of the prior austenite grain size $d_{\gamma}$ was increased. In particular, in the case where $d_{\gamma 0}$ was more than 100 μm, the decrease rate of $d_{\gamma}$ was large. (c) Irrespective of $d_{\gamma 0}$, by performing hardening three times, the prior austenite grain size was converged to a value (about 25 μm) substantially determined by the hardening temperature.

The $A_{c3}$ point (heating rate: 100 to 200° C./Hr) of the steel A used for the evaluations of FIGS. 1A, 1B, 1C, and 2 may change depending on the components and the heating rate, but is usually within a range of 825° C. to 880° C. That is, the hardening temperature of 872° C. adopted in the experiment of FIGS. 1A, 1B, 1C, and 2 is in the very vicinity of $A_{c3}$ point. In the steel A, 870° C.<hardening temperature≤940° C. is recommended. $A_{c3}$ point is affected by chemical components. For example, if the Cr content increases, $A_{c3}$ point also increases. It is recommended that the number of times of hardening in this temperature range is from 2 to 6. In this component system, $A_c3$ point will also be called $A_f$ point, but the point is that $A_{c3}$ point ($A_f$ point) is a temperature at which ferrite phase (martensite or bainite) disappears.

Example 2: Dependence of Impact Value on Cooling Rate

1. Test Method

A U notch test piece (width: 10 mm, height: 10 mm, height below notch: 8 mm, notch bottom radius: 1 mm) was prepared from the steel A before hardening, prepared in Example 1. The obtained test piece was hardened under various conditions such that the austenite grain size $d_\gamma$ during hardening was 25 μm, 85 μm, or 150 μm. The austenite grain size $d_\gamma$ during hardening was adjusted by controlling the initial grain size $d_{\gamma 0}$ and the hardening conditions. The cooling rate of the test piece (from 550° C. to 250° C.) was adjusted in a range of 1 to 100° C./min. The reason why the lower limit of the temperature range in which the cooling rate was controlled was 250° C. is that the end temperature of martensite transformation of the steel A is in a range of 250° C. to 300° C.

After hardening, the test piece was tempered such that the hardness was 38 HRC, and the impact value was evaluated.

2. Result

Figure 3:
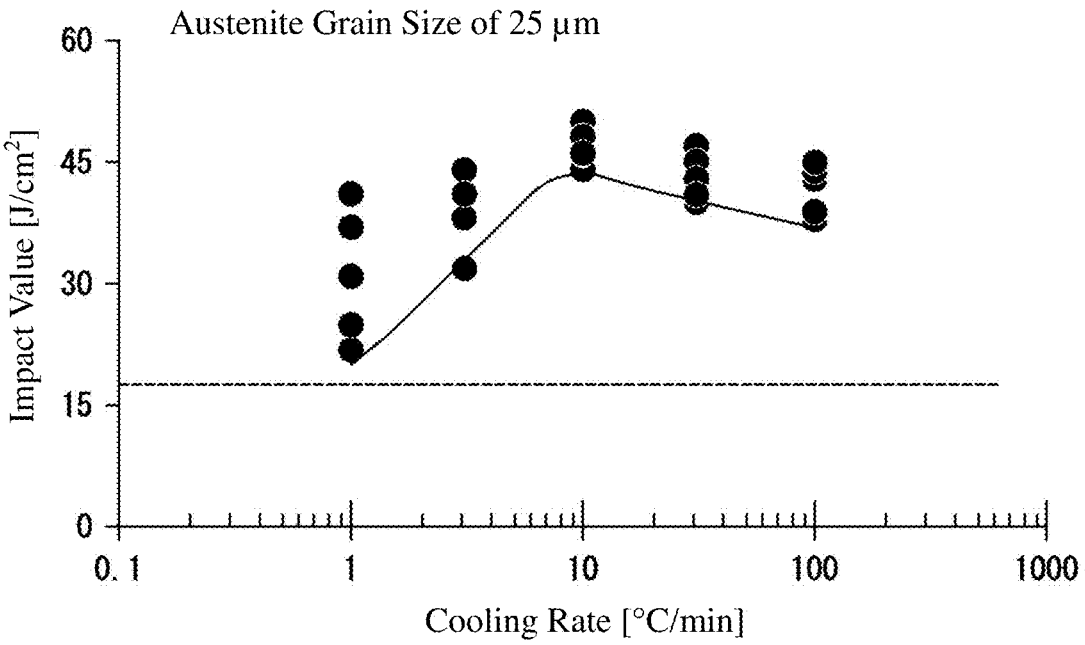
FIG. 3 is a graph showing a relationship between a cooling rate and an impact value in the case where the austenite grain size was 25 μm.
Figure 4:
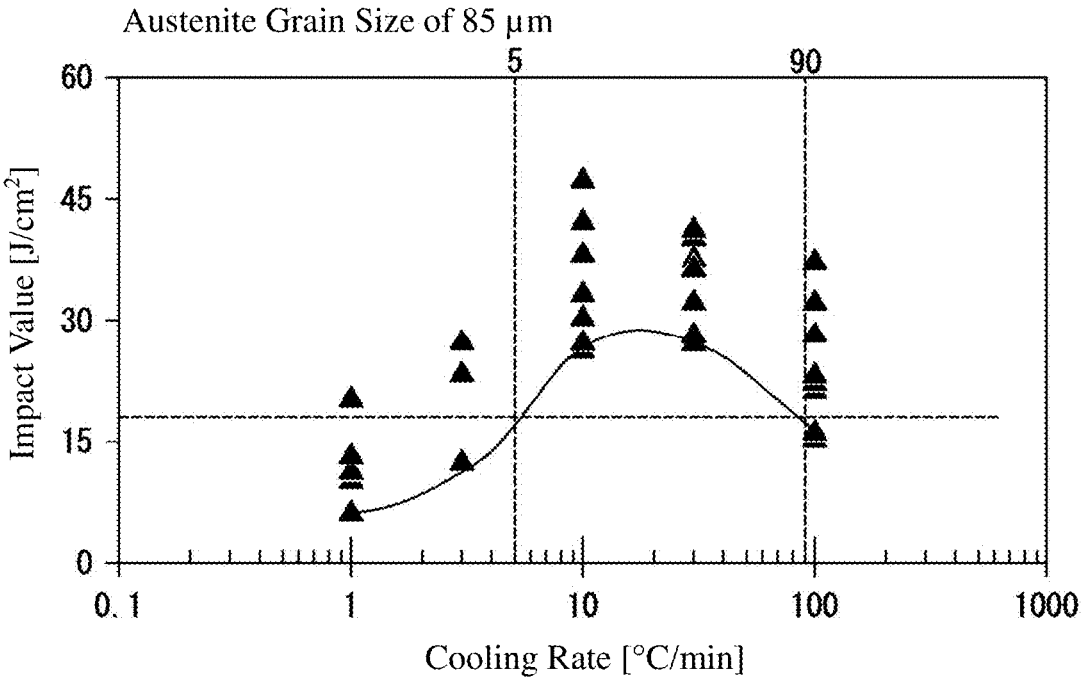
FIG. 4 is a graph showing a relationship between a cooling rate and an impact value in the case where the austenite grain size was 85 μm.
Figure 5:
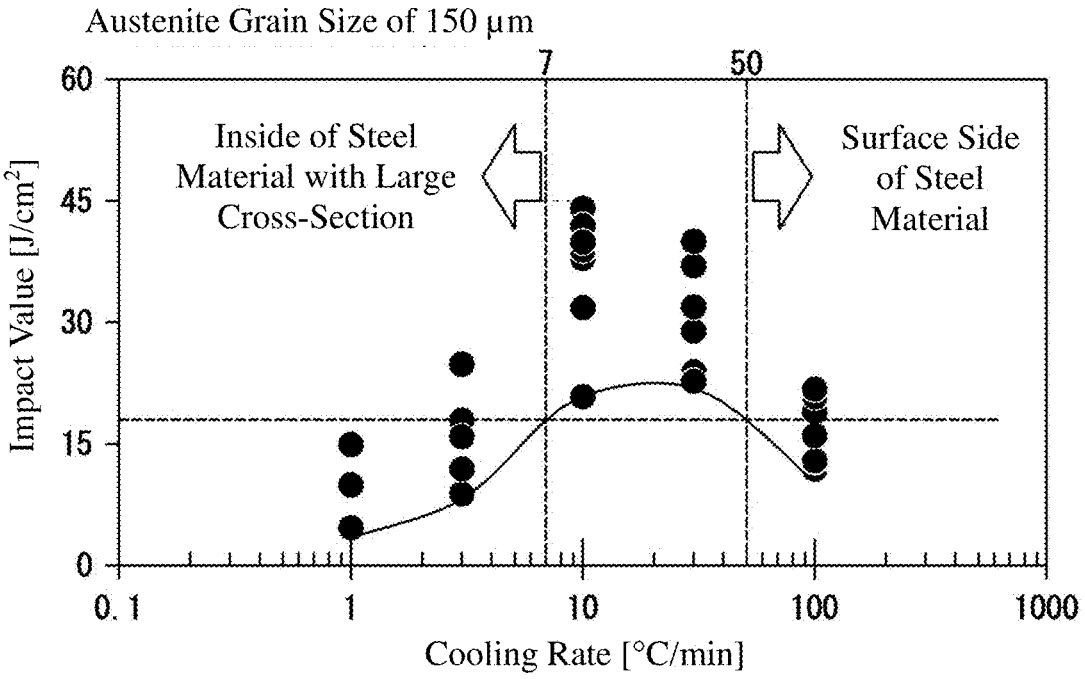
FIG. 5 is a graph showing a relationship between a cooling rate and an impact value in the case where the austenite grain size was 150 μm.

FIGS. 3, 4 and 5 show a relationship between the cooling rate and the impact value in the case where the austenite grain size was 25 Ξm, 85 Ξm, or 150 μm. In FIGS. 3, 4 and 5, a broken line parallel to the horizontal axis represents an impact value of 18 J/cm$^2$.

Typically, as the cooling rate increases, the impact value of steel increases. However, as shown in FIGS. 3, 4 and 5, the impact value of the steel A was high (maximum) in a specific cooling rate range. In the case where the cooling rate was excessively high, the impact value decreased. In addition, it was found that the above-described phenomenon also occurred even in Ni—Al—Cu steel, Ni—Al steel with low Cu content, and Cu steel with low Ni content and low Al content. In addition, it was also found that, even in these steels, the above-described phenomenon appeared particularly in the case where the Mn content was high and the Cr content was low.

3. Measure for Increasing Impact Value in Entire Parts in Cross-Section of Steel Material By utilizing the extremely unique phenomenon appearing in the specific component system that is found in the present invention, the impact value can be increased in the entire parts in the cross-section of the steel A. Hereinafter, the method will be specifically described.

A mold for plastic injection molding is likely to crack in the case where the impact value is lower than 18 J/cm$^2$. Accordingly, in prehardening of steel material for mold, it is necessary to establish a measure for increasing the impact value after tempering to be "18 J/cm$^2$ or higher in the entire parts in the cross-section of the steel material." In order to secure the impact value, two factors including the austenite grain size during hardening and the cooling rate should be considered.

Figure 6:
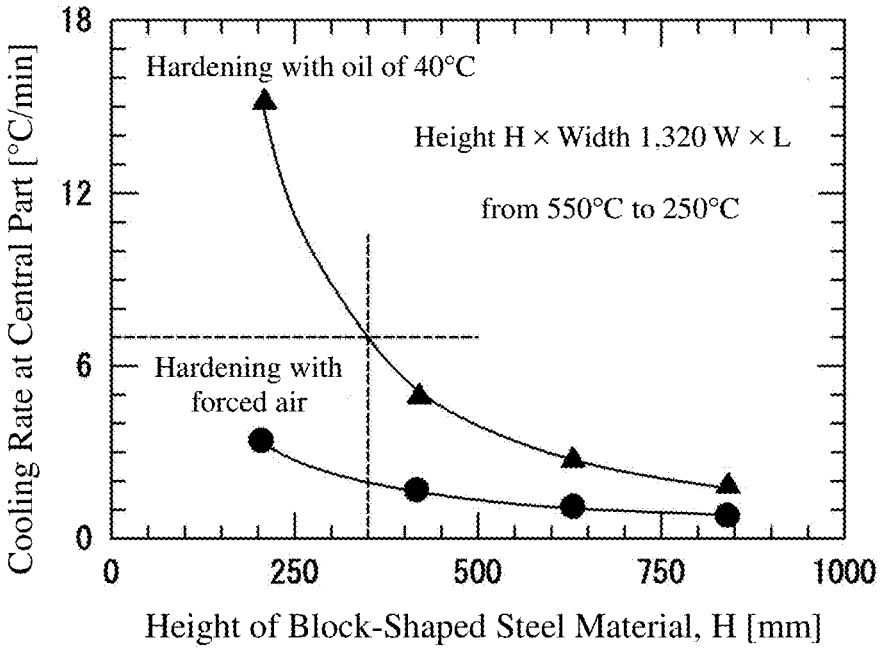
FIG. 6 is an average cooling rate at a central part (cooling rate at a central part) from 550° C. to 250° C. when a block-shaped steel material having a height of H (mm), a width W of 1,320 mm and a length of L (1,320 mm or more) is hardened.

FIG. 6 shows the average cooling rate at a central part (cooling rate at a central part) from 550° C. to 250° C. when a block-shaped steel material having a height of H (mm), a width W of 1,320 mm and a length of L (1,320 mm or more) is hardened. Even when hardening is performed by rapid cooling using an oil of a low temperature of 40° C., in the case where the height (thickness) of the steel material is 350 mm or more, the cooling rate at the central part of the steel material is reduced to be 7° C./min or lower. In the case of water cooling, the cooling rate can be further increased, but it is still difficult to increase the cooling rate at the central part of a steel material having a large cross-sectional size to be 10° C./min or higher. On the other hand, the cooling rate at the surface part (surface central part or corner part) of the steel material is usually 50° C./min or higher. This way, in the cross-section of the steel material, there is a significantly large difference in cooling rate.

Next, "a method of increasing the impact value in the entire parts of the cross-section of a steel material" by combining with the grain refinement during hardening will be described in detail, after grasping the difference in cooling rate between the parts and the absolute value of the cooling rate.

In the case where the steel material has a large cross-sectional size of 350 mm or more in width and 350 mm or more in height and a coolant for hardening is forced air, high-temperature oil, or low-pressure inert gas, as shown in FIG. 6, the cooling rate is reduced to be 7° C./min or lower particularly in the vicinity of the central part of the steel material. At this time, in the case where the austenite grain size at the central part of the steel material during hardening is large as 150 μm or more, an impact value of 18 J/cm$^2$ or higher cannot be satisfied.

On the other hand, in the present invention, as shown in FIGS. 1A to 5, the following measures for hardening are adopted: (a) the austenite grain size (average value) is reduced to be 85 μm or less by repeated hardening; (b) the cooling rate (from 550° C. to 250° C.) at the central part is adjusted to be 5° C./min or higher; and (c) the cooling rate at the surface part is adjusted to be 90° C./min or lower. As a result, in the entire parts in the cross-section, an impact value of 18 J/cm$^2$ or higher can be stably achieved.

Here, the cooling rate is necessarily maintained within a range of 5 to 90° C./min at least in the final hardening. For example, in the case where hardening is performed three times in total, the cooling rates at the first hardening and the second hardening may be outside of the above-described range, but is preferably in the above-described range.

Conventionally, steel materials are hardened at as high rate as possible based on the understanding that, as the cooling rate increases, the impact value increases. However, it was found that, in the component system (chemical composition) of the steel A, the impact value in the surface part at which the cooling rate was high was decreased by rapid cooling. This tendency appears in the case where grains are coarse.

In the case where grains are extremely fine, an impact value of 18 J/cm$^2$ or higher can be obtained even when the cooling rate at the central part is 1° C./min, and it is not necessary to pay much attention to a decrease in cooling rate inside the steel material. In addition, in the case where grains are extremely fine, an impact value of 18 J/cm$^2$ or higher can be obtained also even when the cooling rate at the surface part is 90° C./min or higher, and it is not necessary to pay much attention to rapid cooling at the surface part. From this point of view, it is important to refine the grain.

Conversely, in the case where austenite grains during hardening are extremely coarse, as can be easily estimated from FIG. 5 in which the grain size is outside of the range of the present invention, an impact value of 18 J/cm$^2$ or higher cannot be stably obtained even at 7° C./min or lower at the central part and at 50° C./min or higher at the surface part. That is, in this case, an impact value of 18 J/cm$^2$ or higher cannot be stably obtained at any cooling rate within such a cooling rate range at the central part and at the surface part of a steel material having a large cross-sectional size as described regarding FIG. 6.

In the case where austenite grains during cooling are fine, an impact value of 18 J/cm$^2$ or higher can be obtained even at a cooling rate of 1° C./min. However, the cooling rate is preferably 2° C./min or higher. The reason for this is that, when the microstructure is exposed by an etchant and observed with an optical microscope at a magnification of 100 to 400 times, scattered microstructures that appear to be black become apparent. When observed with an SEM at a high magnification, it was found that a large amount of carbide is present in the region that appears to be black, and this carbide appears to be black when observed with an optical microscope. This non-uniformity in microstructure may cause troubles during mirror polishing or chemical etching (so-called emboss processing, etc.) of a mold. Therefore, it is better to avoid the non-uniformity in microstructure.

Comparative Example 1: Repeated Hardening of 5Cr Die Steel

1. Test Method

A 5Cr die steel material was repeatedly hardened. The cross-sectional size of the steel material had a height of 410 mm and a width of 820 mm. In the first treatment, the steel material was held at 1,030° C. for 3 hours and dipped in oil at 80° C. for hardening and then, the steel material was tempered twice at 580° C. and 610° C. Next, in the second treatment, the steel material was held at 1,030° C. for 3 hours and then was dipped in oil at 80° C. for hardening. This way, repeated hardening was performed.

2. Result

Figure 7A:
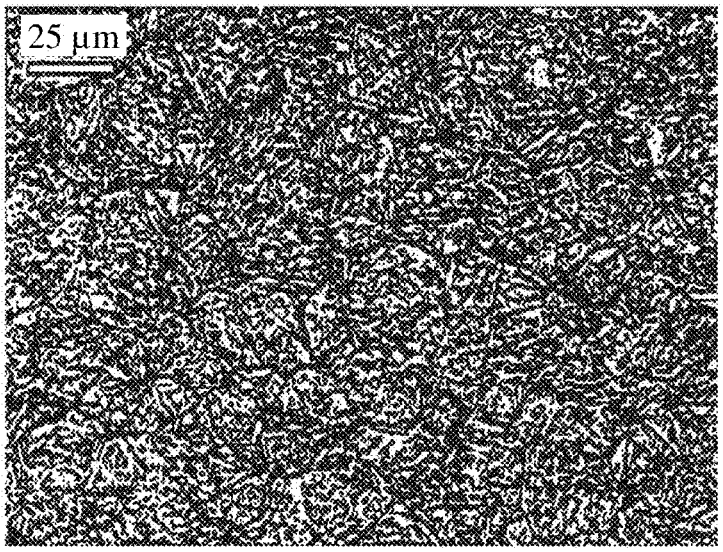
FIGS. 7A and 7B are images showing martensite microstructures of tempered 5Cr die steel.
Figure 7B:
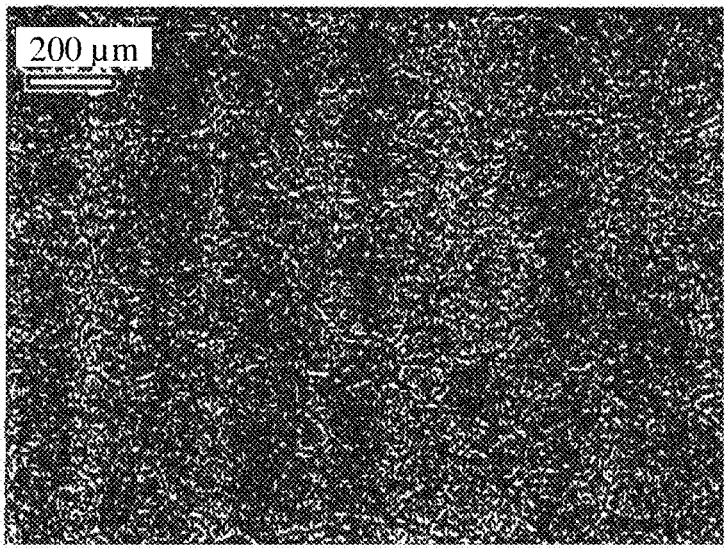

The steel A shows that austenite grain during hardening can be refined by repeated hardening. This is a phenomenon unique to the component system of steel A. In general, in the case where a microstructure of a steel material for mold before hardening is formed of martensite or bainite as in the present invention, coarse grains are generated without obtaining fine grains during hardening. An example of this case is 5Cr die steel. FIG. 7A shows a tempered martensite microstructure (microstructure that was hardened and tempered once) of the 5Cr die steel material. FIG. 7B shows a microstructure after rehardening the 5Cr die steel material shown in FIG. 7A.

FIG. 7A shows a martensite microstructure, and it can be seen from FIG. 7A that the prior austenite grain size during hardening is fine as from 25 to 30 μm. FIG. 7B shows the microstructure after rehardening the 5Cr die steel material of FIG. 7A, and the prior austenite grain size becomes extremely coarse as from 100 to 300 μm.

This way, a general or conventionally recognized characteristic of steels for mold is that the grain size increases (becomes coarse) when performing so-called "rehardening (hardening martensite or bainite again)".

On the other hand, as shown in FIGS. 1A, 1B, 1C, and 2, the component system according to the present invention has an extremely unique characteristic that the grain size is reduced by hardening irrespective of the fact that "martensite as a prior microstructure is hardened".

In structural steel such as so-called SC or SCR, a microstructure before hardening can be controlled to be a ferrite-pearlite microstructure, and the grain size of the coarse ferrite-pearlite microstructure can be reduced by performing hardening once. However, this hardening is essentially different from hardening in which martensite or bainite is a prior microstructure in the viewpoint of nucleation sites of austenite.

Example 3 and Comparative Example 2

1. Preparation of Sample

Each of steels having chemical compositions shown in Table 1 was melted and cast in 10 tons of ingot. The ingot was soaked at 1,240° C., subjected to a hot plastic working, forged to have a rectangular cross-section having a height of 410 mm and a width of 820 mm, and then, cooled up to about 100° C. In Table 1, steels A1 to A17 represent steel materials (Example 3) having a composition within the range of the present invention. Steels B1 to B5 represent steel materials (Comparative Example 2) having a composition outside of the range of the present invention.

The rectangular material is hardened to have a microstructure of martensite or bainite, and when the rectangular material is left to stand, season cracking may occur. In order to avoid season cracking, immediately after the completion of the hot plastic working, the rectangular material was heated at 580° C. for 8 hours for tempering and then cooled to room temperature.

A small block for foundationally investigating a microstructural change during hardening was prepared from the rectangular material. Specifically, a plate (410 mm×820 mm×50 mm) having a thickness of 50 mm was cut out from the rectangular material, and a block having a size of 15 mm×15 mm×20 mm was prepared from the plate by machining.

This block was heated at 1,160° C. for 3 hours to obtain coarse austenite grains simulating a hot plastic working and then, cooled to room temperature. When the obtained martensite microstructure was observed, it was found that an average value of prior austenite grain size was 223 μm after heating at 1,160° C. for 3 hours. With respect to this state as an initial state, a microstructural change caused by repeated hardening was investigated.

TABLE 1

| Steel | C | Si | Mn | S | Cu | Ni | Cr | Mo | Al | Selected Addition |
|---|---|---|---|---|---|---|---|---|---|---|
| A1 | 0.13 | 0.30 | 1.54 | 0.0005 | 1.02 | 3.16 | 0.25 | 0.26 | 1.13 | — |
| A2 | 0.14 | 0.28 | 1.56 | 0.1390 | 0.99 | 3.13 | 0.31 | 0.24 | 0.97 | — |
| A3 | 0.12 | 0.29 | 0.51 | 0.0005 | 1.00 | 3.08 | 2.68 | 0.27 | 1.05 | — |
| A4 | 0.12 | 0.29 | 0.49 | 0.0041 | 0.75 | 2.26 | 2.71 | 0.28 | 0.75 | — |
| A5 | 0.14 | 0.27 | 0.42 | 0.0009 | 0.55 | 2.77 | 2.74 | 0.25 | 1.33 | — |
| A6 | 0.07 | 0.03 | 1.75 | 0.0005 | 0.80 | 2.92 | 0.24 | 0.11 | 0.81 | — |
| A7 | 0.21 | 0.79 | 1.70 | 0.0972 | 1.33 | 3.70 | 0.60 | 0.50 | 1.28 | — |
| A8 | 0.25 | 0.47 | 0.61 | 0.2247 | 1.77 | 3.89 | 3.18 | 0.79 | 1.49 | — |
| A9 | 0.05 | 0.02 | 1.38 | 0.0004 | 0.41 | 2.03 | 0.06 | 0.77 | 0.31 | — |
| A10 | 0.10 | 0.07 | 1.22 | 0.0098 | 0.70 | 2.22 | 0.42 | 0.69 | 0.43 | 0.92W |
| A11 | 0.18 | 0.16 | 1.30 | 0.0161 | 1.07 | 2.43 | 0.96 | 0.07 | 0.57 | 1.03Co |
| A12 | 0.12 | 0.40 | 1.10 | 0.0335 | 1.68 | 2.64 | 1.49 | 0.33 | 0.71 | 0.86W,1.47Co |
| A13 | 0.15 | 0.53 | 1.19 | 0.0654 | 0.89 | 2.91 | 1.97 | 0.42 | 0.89 | 0.0018B |
| A14 | 0.18 | 0.66 | 0.99 | 0.1073 | 1.21 | 3.01 | 3.19 | 0.61 | 0.61 | 0.14Bi |
| A15 | 0.21 | 0.95 | 0.89 | 0.1610 | 1.46 | 3.29 | 3.03 | 0.23 | 1.22 | 0.09Bi,0.03Te |
| A16 | 0.24 | 0.02 | 0.80 | 0.1903 | 1.59 | 3.49 | 0.09 | 0.15 | 1.39 | 0.17Bi,0.98W |
| A17 | 0.22 | 0.90 | 0.70 | 0.2572 | 0.32 | 3.70 | 0.78 | 0.06 | 1.43 | 0.03Te,1.01Co |

TABLE 1-continued

| Steel | C | Si | Mn | S | Cu | Ni | Cr | Mo | Al | Selected Addition |
|---|---|---|---|---|---|---|---|---|---|---|
| B1 | 0.05 | 1.19 | 0.45 | 0.0008 | 0.45 | 3.05 | 4.05 | 1.00 | 0.74 | — |
| B2 | 0.11 | 0.25 | 2.55 | 0.0060 | 0.04 | 1.04 | 3.02 | 0.28 | 0.01 | — |
| B3 | 0.04 | 0.73 | 0.27 | 0.0006 | 0.77 | 2.88 | 5.70 | 0.63 | 0.69 | — |
| B4 | 0.09 | 0.20 | 1.12 | 0.0240 | 0.44 | 0.04 | 4.07 | 0.57 | 0.01 | 0.13 V |
| B5 | 0.09 | 0.24 | 1.14 | 0.3264 | 0.67 | 1.21 | 3.98 | 0.38 | 0.41 | — |

(mass %, a remainder being Fe and unavoidable impurities)

2. Verification 2.1. Verification 1: Repeated Hardening at Around $A_{c3}$ Point 2.1.1. Test Method To the 22 kinds of blocks were subjected repeated hardening at temperatures shown in Table 2 four times. The $A_{c3}$ point in Table 2 refers to the $A_{c3}$ transformation point measured in the case where a test piece having a size of 4 mm in diameter×10 mm in thickness prepared from the block was heated at a rate of 200° C. per hour. Based on the $A_{c3}$ point, the hardening temperature at which the block was repeatedly hardened four times was set to be ($A_{c3}$ point−18° C.)≤hardening temperature≤($A_{c3}$ point+52° C.). The holding time at the hardening temperature was set as 5 hours in order to sufficiently solutionize alloy elements in austenite.

TABLE 2

| Steel | $Ac_3$ Point [° C.] | Hardening Temperature [° C.] | Hardening Temperature —$Ac_3$ Point [° C.] | Average value [μm] of Prior Austenite Grain Sizes after Hardening First | Second | Third | Fourth |
|---|---|---|---|---|---|---|---|
| A1 | 867 | 872 | 5 | 121 | 73 | 28 | 27 |
| A2 | 858 | 872 | 14 | 86 | 55 | 27 | 28 |
| A3 | 884 | 872 | −12 | 148 | 72 | 39 | 37 |
| A4 | 897 | 900 | 3 | 93 | 65 | 43 | 41 |
| A5 | 893 | 900 | 7 | 94 | 62 | 44 | 43 |
| A6 | 862 | 872 | 10 | 90 | 48 | 24 | 25 |
| A7 | 846 | 872 | 26 | 87 | 52 | 34 | 32 |
| A8 | 891 | 900 | 9 | 88 | 61 | 45 | 46 |
| A9 | 875 | 872 | −3 | 111 | 71 | 33 | 27 |
| A10 | 874 | 872 | −2 | 108 | 73 | 32 | 29 |
| A11 | 874 | 900 | 26 | 89 | 52 | 41 | 43 |
| A12 | 877 | 900 | 23 | 91 | 56 | 43 | 45 |
| A13 | 880 | 900 | 20 | 93 | 58 | 44 | 42 |
| A14 | 903 | 900 | −3 | 96 | 65 | 45 | 45 |
| A15 | 903 | 910 | 7 | 103 | 86 | 63 | 52 |
| A16 | 863 | 872 | 9 | 90 | 49 | 30 | 28 |
| A17 | 890 | 872 | −18 | 162 | 98 | 67 | 48 |
| B1 | 923 | 910 | −13 | 218 | 241 | 193 | 205 |
| B2 | 820 | 872 | 52 | 195 | 179 | 206 | 231 |
| B3 | 857 | 872 | 15 | 247 | 196 | 171 | 214 |
| B4 | 836 | 872 | 36 | 202 | 218 | 215 | 206 |
| B5 | 827 | 872 | 45 | 167 | 203 | 124 | 103 |

2.1.2. Result

Table 2 shows the average value (μm) of prior austenite grain sizes when the number of times of hardening is one to four. The following can be seen from Table 2. (1) The steels B1 to B5 showed a general characteristic as steels for mold that the grain size is not reduced by repeated hardening, that is, the grain size is not reduced by so-called "rehardening of martensite (or bainite). (2) In the steels A1 to A17, a grain refinement was promoted by repeated hardening, and the grain size was 85 μm or less at least after the third hardening. The difference in grain size between the fourth hardening and the third hardening was small. It is considered that three times of repeated hardening is sufficient in the case where the initial grain size is 223 μm as the present case. (3) On the other hand, in the case where the initial grain size is further large, for example, the central part of rectangular steel having an extremely large cross-sectional size or a surface-side dead metal zone (a part that is restricted and not likely to be deformed due to a geometric factor with a hot plastic working tool, due to a temperature decrease or due to a high frictional coefficient such that it is difficult to reduce the grain size by recrystallization), it is presumed that four or more times of repeated hardening is necessary. (4) Conversely, in the case where the initial grain size is not so large, two times of repeated hardening is likely to be sufficient. Actually, in the steels except for the steel A15 and steel A17, the grain size was reduced to be 85 μm or less after the second hardening. However, it cannot be said that a grain refinement is sufficient in some steel.

2.2. Verification 2: Repeated Hardening at Lower than $A_{c3}$ Point−30° C.

2.2.1. Test Method

Regarding the steels A1 to A17 in which a grain refinement by repeated hardening at around $A_{c3}$ point was confirmed, repeated hardening at the hardening temperature< ($A_{c3}$−30° C.) was verified. The hardening temperature at which the block was repeatedly hardened four times was set to be ($A_{c3}$ point−60° C.)<hardening temperature≤($A_{c3}$ point−42° C.). The holding time at the hardening temperature was set as 5 hours according to the experiment of Table 2 (Verification 1).

2.2.2. Result

Table 3 shows the average value [μm] of prior austenite grain sizes when the number of times of hardening is one to four. The following can be seen from Table 3. (1) In all the steels A1 to A17, the prior austenite grain size cannot be reduced to 85 μm or less. Although the components were the same and the hardening temperature was lower than that of the corresponding experiment of Table 2 (Verification 1), a change in grain size from the initial large grain size was small. Here, the average grain size is shown in Table 3, but actually a significantly mixed grain structure was produced. In a fine grain part, grains having a grain size of 20 μm or so were present. However, most of the parts are occupied by large grains having a grain size similar to the initial large grain size. As the number of times of hardening decreased, the proportion of the coarse grains increased. (2) In this verification, hardening was performed in a state where austenitizing was insufficient. Therefore, a phenomenon such as a so-called "memory effect" may occur. In either case, in repeated hardening at a temperature significantly lower than $A_{c3}$ point, a fine grain microstructure having a grain size of 85 μm or less was not able to be obtained even in the chemical composition range of the present invention.

TABLE 3

| Steel | $Ac_3$ Point [° C.] | Hardening Temperature [° C.] | Hardening Temperature —$Ac_3$ Point [° C.] | Average value [μm] of Prior Austenite Grain Sizes after Hardening First | Second | Third | Fourth |
|---|---|---|---|---|---|---|---|
| A1 | 867 | 820 | −47 | 211 | 205 | 195 | 183 |
| A2 | 858 | 810 | −48 | 213 | 199 | 186 | 185 |
| A3 | 884 | 840 | −44 | 207 | 203 | 181 | 182 |
| A4 | 897 | 840 | −57 | 210 | 206 | 184 | 204 |
| A5 | 893 | 840 | −53 | 204 | 202 | 191 | 188 |
| A6 | 862 | 820 | −42 | 198 | 195 | 197 | 197 |
| A7 | 846 | 800 | −46 | 213 | 200 | 183 | 181 |
| A8 | 891 | 840 | −51 | 206 | 201 | 197 | 195 |
| A9 | 875 | 830 | −45 | 212 | 212 | 196 | 190 |
| A10 | 874 | 820 | −54 | 218 | 206 | 209 | 206 |
| A11 | 874 | 820 | −54 | 212 | 211 | 208 | 205 |
| A12 | 877 | 820 | −57 | 210 | 205 | 211 | 209 |
| A13 | 880 | 820 | −60 | 211 | 191 | 194 | 202 |
| A14 | 903 | 850 | −53 | 210 | 211 | 209 | 204 |
| A15 | 903 | 850 | −53 | 205 | 207 | 206 | 208 |
| A16 | 863 | 820 | −43 | 197 | 195 | 186 | 191 |
| A17 | 890 | 840 | −50 | 207 | 201 | 195 | 194 |

2.3. Verification 3: Repeated Hardening at Higher than $A_{c3}$ Point+60° C.

2.3.1. Test Method

Regarding the steels A1 to A17 in which a grain refinement by repeated hardening at around the $A_{c3}$ point was confirmed, repeated hardening at ($A_{c3}$+60° C.)<hardening temperature was verified. The hardening temperature at which the block was repeatedly hardened four times was set to be ($A_{c3}$ point+63° C.)<hardening temperature<($A_{c3}$ point+90° C.). The holding time at the hardening temperature was set as 5 hours according to the experiment of Table 2 (Verification 1).

2.3.2. Result

Table 4 shows the average value [μm] of prior austenite grain sizes when the number of times of hardening is one to four. The following can be seen from Table 4. (1) In all the steels A1 to A17, the prior austenite grain size cannot be reduced to 85 μm or less. Unlike the experiment of Table 3 (Verification 2), the initial large grain size was reduced, but due to the high temperature, it is difficult to suppress the movement of grain boundaries (i.e., grain growth) by diffusion. In repeated hardening at a temperature significantly higher than $A_{c3}$ point, a fine grain microstructure having a grain size of 85 μm or less was not able to be obtained even in the chemical composition range of the present invention.

(2) A method of further increasing the number of times of hardening can also be considered. However, there was only small difference in grain size between after the third hardening and after the fourth hardening. Therefore, it is determined that, even if the number of times of hardening is five or more, it may be difficult to stably obtain grains having a grain size of 85 μm or less in this temperature range.

TABLE 4

| Steel | $Ac_3$ Point [° C.] | Hardening Temperature [° C.] | Hardening Temperature —$Ac_3$ Point [° C.] | Average value [μm] of Prior Austenite Grain Sizes after Hardening First | Second | Third | Fourth |
|---|---|---|---|---|---|---|---|
| A1 | 867 | 940 | 73 | 108 | 96 | 88 | 88 |
| A2 | 858 | 940 | 82 | 105 | 94 | 90 | 91 |
| A3 | 884 | 960 | 76 | 146 | 123 | 111 | 112 |
| A4 | 897 | 960 | 63 | 111 | 108 | 105 | 104 |
| A5 | 893 | 960 | 67 | 113 | 100 | 94 | 96 |
| A6 | 862 | 940 | 78 | 120 | 101 | 92 | 90 |
| A7 | 846 | 940 | 94 | 100 | 93 | 91 | 91 |
| A8 | 891 | 960 | 69 | 132 | 120 | 114 | 113 |
| A9 | 875 | 960 | 85 | 130 | 119 | 112 | 113 |
| A10 | 874 | 960 | 86 | 120 | 114 | 109 | 108 |
| A11 | 874 | 940 | 66 | 113 | 97 | 90 | 90 |
| A12 | 877 | 940 | 63 | 111 | 94 | 88 | 89 |
| A13 | 880 | 960 | 80 | 131 | 123 | 120 | 119 |

TABLE 4-continued

| Steel | $Ac_3$ Point [° C.] | Hardening Temperature [° C.] | Hardening Temperature —$Ac_3$ Point [° C.] | Average value [μm] of Prior Austenite Grain Sizes after Hardening First | Second | Third | Fourth |
|---|---|---|---|---|---|---|---|
| A14 | 903 | 980 | 77 | 169 | 158 | 152 | 153 |
| A15 | 903 | 980 | 77 | 151 | 149 | 141 | 143 |
| A16 | 863 | 960 | 97 | 134 | 122 | 118 | 116 |
| A17 | 890 | 980 | 90 | 148 | 138 | 136 | 137 |

2.4. Verification 4: Effect of Increasing Impact Value by Repeated Hardening 2.4.1. Test Method Whether or not a high impact value can be obtained in the entire parts of the steel material having a large cross-sectional size in the case where hardening was repeated at around $A_{c3}$ point three times was verified. The raw material was a rectangular material having a size of 410 mm in height and 820 mm in width and was made of a remainder that remained after cutting the sheet (410 mm×820 mm×50 mm) for preparing the blocks used in 2.1 to 2.3 (Verifications 1 to 3).

From this raw material, two samples having a length of 1,400 mm were cut. In the raw material, the prior austenite grain size was about 70 μm in the vicinity of the surface part and about 220 μm in the vicinity of the central part. Thus, there was a difference in grain size in the cross-section. The reason for this is that the temperature during hot plastic working or strain history varies.

As the cooling for hardening, forced air cooling (until the temperature at the central part reached 200° C.) was employed in the initial two times of hardening. In the final third hardening, water cooling or oil cooling was employed. Regarding a method for the third hardening, transitions in the temperatures at the central part and the surface part during hardening were estimated by numerical analysis, and the process was designed in consideration of the cooling rate.

"Hardening method A" is a process of dipping the steel material in water of 40° C. in which forced convection was generated. In the method A, the steel material was cooled in water until the temperature at the central part reached 200° C. or lower. In the method A, the cooling rate (from 550° C. to 250° C.) was about 150° C./min at the corner of the surface part and about 7° C./min at the central part.

"Hardening method B" is a process of dipping the steel material in an oil of 80° C. in which forced convection was generated. In the method B, the steel material was pulled up from the oil several times to reheat the surface and then dipped in the oil again. This operation was repeated until the central part was cooled to 200° C. or lower. In the method B, the cooling rate (from 550° C. to 250° C.) was about 70° C./min at the corner of the surface part and about 4° C./min at the central part.

After the third hardening, the steel material was tempered at 520° C. to 560° C. to have a hardness of about 40 HRC. Next, 10 impact test pieces (the above-described U notch test pieces) were cut out from each of the corner of the surface part, the vicinity of the center of the raw material and an intermediate part therebetween. Impact values were evaluated at room temperature, and the average value in 10 test pieces was calculated.

2.4.2. Result

Table 5 shows the impact value (the average value of 10 test pieces) of each of the parts. For reference, Table 5 also shows the prior austenite grain size in the third hardening. The following can be seen from Table 5. (1) The impact values varied depending on the hardening methods and the parts, but the average value was 18 J/cm$^2$ or higher in all the steels A1 to A17. Incidentally, as for the steel A15 and steel A17 having a slightly large grain size, in the vicinity of the corners in the case of the hardening method A, although the average value was 18 J/cm$^2$, but one or two test pieces among 10 test pieces were lower than 18 J/cm$^2$. Therefore, the steel A15 and steel A17 were not perfect from the viewpoint of stability. This is a result of the expression of the characteristic of the component system (chemical composition) of the present invention, that is, in the case where the cooling rate was excessively high, the impact value conversely decreased. (2) Even in the steel A15 and steel A17, the impact values were highly stable in the hardening method B of limiting the difference in the cooling rate in the cross-section to a narrow range. The reason for this is as follows. In typical steels for mold, the impact value is decreased by a decrease in cooling rate. However, in the component system according to the present invention, in the case where the cooling rate is within a range of 10 to 20° C./min or higher, the impact value is increased by a decrease in cooling rate. (3) In the other steels, the impact value was highly stable at 21 J/cm$^2$ or higher.

TABLE 5

| Steel | Hardening Temp. [° C.] | Impact Value [J/cm$^2$] Hardening Method A Vicinity of Center | Intermediate | Vicinity of Corner | Hardening Method B Vicinity of Center | Intermediate | Vicinity of Corner | Note | Grain Size after Third Hardening |
|---|---|---|---|---|---|---|---|---|---|
| A1 | 872 | 38 | 43 | 41 | 37 | 41 | 37 | | 28 |
| A2 | 872 | 39 | 43 | 41 | 37 | 42 | 38 | | 27 |
| A3 | 872 | 35 | 36 | 36 | 34 | 38 | 33 | | 39 |
| A4 | 900 | 32 | 32 | 25 | 32 | 36 | 26 | | 43 |
| A5 | 900 | 33 | 30 | 23 | 29 | 36 | 27 | | 44 |
| A6 | 872 | 40 | 44 | 42 | 38 | 43 | 39 | | 24 |
| A7 | 872 | 36 | 41 | 39 | 35 | 39 | 35 | | 34 |

TABLE 5-continued

| Steel | Hardening Temp. [° C.] | Impact Value [J/cm²] Hardening Method A Vicinity of Center | Hardening Method A Intermediate | Hardening Method A Vicinity of Corner | Hardening Method B Vicinity of Center | Hardening Method B Intermediate | Hardening Method B Vicinity of Corner | Note | Grain Size after Third Hardening |
|---|---|---|---|---|---|---|---|---|---|
| A8 | 900 | 31 | 31 | 22 | 28 | 36 | 25 | | 45 |
| A9 | 872 | 37 | 41 | 39 | 36 | 39 | 35 | | 33 |
| A10 | 872 | 36 | 41 | 40 | 35 | 40 | 35 | | 32 |
| A11 | 900 | 33 | 34 | 25 | 32 | 37 | 30 | | 41 |
| A12 | 900 | 33 | 37 | 23 | 30 | 36 | 28 | | 43 |
| A13 | 900 | 34 | 37 | 22 | 29 | 36 | 26 | | 44 |
| A14 | 900 | 31 | 30 | 21 | 27 | 36 | 25 | | 45 |
| A15 | 910 | 30 | 28 | 18 | 24 | 35 | 23 | Vicinity of Corner in Method A: One Test Piece was less than 18 J/cm² | 63 |
| A16 | 872 | 37 | 42 | 40 | 36 | 40 | 36 | | 30 |
| A17 | 872 | 29 | 26 | 18 | 23 | 33 | 22 | Vicinity of Corner in Method A: Two Test Pieces were less than 18 J/cm² | 67 |

It was found that, by repeating hardening at around $A_{c3}$ point as described above, the grain size distribution in the cross-section can be homogenized, and a high impact value can be stably obtained. In addition, if the cooling rate is controlled simultaneously, a high impact value can be effectively obtained even in the case where grains are slightly coarse.

Hereinabove, the embodiment of the present invention has been described. However, the present invention is not limited to the embodiment, and various changes and modifications can be made within a range not departing from the scope of the present invention.

The present application is based on Japanese patent application No. 2017-083121 filed on Apr. 19, 2017 and Japanese patent application No. 2018-006778 filed on Jan. 18, 2018, which contents are incorporated herein by reference.

INDUSTRIAL APPLICABILITY

The prehardened steel material according to the present invention can be used for a mold or mold component used for plastic or resin injection molding, rubber molding or forming, CFPR molding or forming or processing, and the like.

Furthermore, it is also effective to use the prehardened steel material according to the present invention and surface treatment (e.g., shot peening, carbo-nitriding, nitriding, PVD, CVD, plating) in combination.

In addition, the prehardened steel material according to the present invention is also applicable to powder or a sheet used for additive manufacturing (e.g., 3D-printing). After being formed in a wire rod shape, the prehardened steel material according to the present invention can also be used for welding repair of a mold or mold component.

What is claimed is:

1. A prehardened steel material, comprising:

0.05≤C≤0.25 mass %;
0.01≤Si≤1.00 mass %;
0.40≤Mn≤1.80 mass %;
0.0002≤S≤0.3000 mass %;
0.30≤Cu≤1.80 mass %;
2.00≤Ni≤3.90 mass %;
0.05≤Cr≤0.60 mass %;
0.05≤Mo≤0.80 mass %; and
0.30≤Al≤1.50 mass %, and optionally:

W≤1.00 mass %;
Co≤2.00 mass %;
B≤0.0050 mass %;
Ca≤0.2000 mass %;
Se≤0.50 mass %;
Te≤0.100 mass %;
Bi≤0.50 mass %; and
Pb≤0.50 mass %, with a balance being Fe and unavoidable impurities, wherein the prehardened steel material has:

a cross-sectional size of 350 mm or more in width and 350 mm or more in height;
a hardness of 34 HRC to 43 HRC;
an average value of prior austenite grain size of 85 μm or less; and
an average value of impact value of 18 J/cm² or higher, the impact value being obtained by dividing an absorption energy by a cross-sectional area: 0.8 cm² of a U notch test piece (test piece length: 55 mm, test piece width: 10 mm, test piece height: 10 mm, height below notch: 8 mm, notch bottom radius: 1 mm), when the test piece is fractured by impact at a room temperature in a range of from 16° C. up to 30° C., and an average value of 10 test pieces is defined as the average value of impact value.

2. The prehardened steel material according to claim 1, comprising at least one element selected from the group consisting of:

0.30<W≤1.00 mass %; and
0.30<Co≤2.00 mass %.

3. The prehardened steel material according to claim 1, comprising:

0.0001<B≤0.0050 mass %.

4. The prehardened steel material according to claim 1, comprising at least one element selected from the group consisting of:

0.0005<Ca≤0.2000 mass %;
0.03<Se≤0.50 mass %;
0.005<Te≤0.100 mass %;
0.01<Bi≤0.50 mass %; and
0.03<Pb≤0.50 mass %.

5. A mold comprising the prehardened steel material described in claim 1, and having a size in which maximum values in at least two directions among three directions of a vertical direction, a horizontal direction and a height direction are 350 mm or more.

6. A mold component comprising the prehardened steel material described in claim 1, and having a size in which maximum values in at least two directions among three directions of a vertical direction, a horizontal direction and a height direction are 350 mm or more.

7. The prehardened steel material according to claim 1, wherein $0.30<W\leq1.00$ mass %.

8. The prehardened steel material according to claim 1, wherein $0.80\leq Cu\leq1.30$ mass %.

9. A prehardened steel material, comprising:

$0.05\leq C\leq0.25$ mass %;

$0.01\leq Si\leq1.00$ mass %;

$0.40\leq Mn\leq1.80$ mass %;

$0.0002\leq S\leq0.3000$ mass %;

$0.30\leq Cu\leq1.80$ mass %;

$2.00\leq Ni\leq3.90$ mass %;

$0.05\leq Cr\leq0.60$ mass %;

$0.05\leq Mo\leq0.80$ mass %;

$0.30\leq Al\leq1.50$ mass %, and at least one element selected from the group consisting of:

$W\leq1.00$ mass %;

$Co\leq2.00$ mass %;

$B\leq0.0050$ mass %;

$Ca\leq0.2000$ mass %;

$Se\leq0.50$ mass %;

$Te\leq0.100$ mass %;

$Bi\leq0.50$ mass %; and $Pb\leq0.50$ mass %, with a balance being Fe and unavoidable impurities.

10. The prehardened steel material according to claim 9, wherein the prehardened steel material has a cross-sectional size of 350 mm or more in width and 350 mm or more in height.

11. The prehardened steel material according to claim 9, wherein the prehardened steel material has a hardness of 34 HRC to 43 HRC.

12. The prehardened steel material according to claim 9, wherein the prehardened steel material has an average value of prior austenite grain size of 85 μm or less.

13. The prehardened steel material according to claim 9, wherein the prehardened steel material has an average value of impact value of 18 $J/cm^2$ or higher, the impact value being obtained by dividing an absorption energy by a cross-sectional area: 0.8 $cm^2$ of a U notch test piece (test piece length: 55 mm, test piece width: 10 mm, test piece height: 10 mm, height below notch: 8 mm, notch bottom radius: 1 mm), when the test piece is fractured by impact at a room temperature in a range of from 16° C. up to 30° C., and an average value of 10 test pieces is defined as the average value of impact value.

14. The prehardened steel material according to claim 9, wherein $0.30<W\leq1.00$ mass %.

15. The prehardened steel material according to claim 9, comprising one element selected from the group consisting of:

$0.30<W\leq1.00$ mass %; and $0.30<Co\leq2.00$ mass %.

16. The prehardened steel material according to claim 9, comprising at least one element selected from the group consisting of:

$0.0005<Ca\leq0.2000$ mass %;

$0.03<Se\leq0.50$ mass %;

$0.005<Te\leq0.100$ mass %;

$0.01<Bi\leq0.50$ mass %; and $0.03<Pb\leq0.50$ mass %.

17. The prehardened steel material according to claim 9, wherein $0.40\leq Cu\leq1.65$ mass %.

18. The prehardened steel material according to claim 9, wherein $0.80\leq Cu\leq1.30$ mass %.

* * * * *